United States Patent [19]

Niksich et al.

[11] 4,271,982

[45] Jun. 9, 1981

[54] GLUE DISPENSER

[75] Inventors: Eugene J. Niksich, Aurora, Ohio; J. Larry Underwood, Woodstock, Ga.

[73] Assignee: Dynatron/Bondo Corporation, Atlanta, Ga.

[21] Appl. No.: 75,805

[22] Filed: Sep. 14, 1979

[51] Int. Cl.[3] ..... B65D 17/44; E65D 35/54

[52] U.S. Cl. ..... 222/83; 222/501; 222/518; 401/260

[58] Field of Search ..... 222/501, 518, 514, 402.25, 222/402.24, 322, 91, 81, 83, 212; 401/135, 264, 260

[56] References Cited

U.S. PATENT DOCUMENTS

| | | | |
|---|---|---|---|
| 1,865,484 | 7/1932 | Roos | 222/91 |
| 2,714,475 | 8/1955 | Roehrich | 222/501 |
| 2,771,218 | 11/1956 | Henderson | 222/83 |
| 2,805,794 | 9/1957 | Amon | 222/501 X |
| 2,984,393 | 5/1961 | Magnenat | 222/501 |
| 3,825,159 | 7/1974 | Laauwe | 222/402.24 |

FOREIGN PATENT DOCUMENTS

| | | | |
|---|---|---|---|
| 511920 | 1/1955 | Italy | 222/81 |

*Primary Examiner*—Robert J. Spar
*Assistant Examiner*—Frederick R. Handren
*Attorney, Agent, or Firm*—Jones, Thomas & Askew

[57] ABSTRACT

The glue dispenser comprises a collapsible tube having an externally threaded spout. A nozzle assembly comprises an internal nozzle threaded onto the spout and a external nozzle mounted on the internal nozzle. A nozzle valve registers with the opening of the external nozzle and is biased into closing engagement therewith by a deformable portion of the valve being urged against a cam surface. A piercing element is formed on the internal nozzle element, and when the nozzle is completely threaded down on the threads of the spout of the collapsible tube, the piercing element penetrates the sealing diaphragm of the spout so that the material in the collapsible tube can be squeezed through the spout and through the nozzle, with the nozzle valve controlling the flow of the material from the dispenser.

6 Claims, 7 Drawing Figures

GLUE DISPENSER

BACKGROUND OF THE INVENTION

This invention relates to a dispenser for dispensing glue in small quantities from a collapsible tube or other container through a nozzle mounted on the collapsible tube, and includes a nozzle valve for immediately closing the nozzle when the glue is not to be dispensed from the tube.

Collapsible tubes have been in common use for the purpose of storing and dispensing pastes such as glue and other substances. The collapsible tubes usually include an externally threaded spout and an internally threaded cap that closes the spout to keep the glue in the tube and to prevent hardening of the glue within the tube. The collapsible tubes are desirable for dispensing glue since the tubes can be completely filled with the glue and the tube closed without trapping air inside the tube, and when the glue is to be dispensed from the tube the tube is squeezed to urge the glue through the open spout and no air is required to enter the tube to dispense the glue. This prevents the air from contacting the glue inside the collapsible tube.

The new fast hardening glues such as cyanoacrylate harden within about one minute after exposure to the atmosphere. Thus, it is imperative that the glue be stored in an air-free environment within the collapsible tube dispenser so as to maintain a long shelf life prior to its sale, and after its sale and when the cap is removed to open the spout and a portion of the glue dispensed from the tube it is imperative that the cap be immediately placed back on the spout of the tube to prevent air from entering the tube and from hardening the glue in the tube.

It has become customary to equip the tubes of fast hardening glues with special nozzles which are elongated and have very small nozzle openings that tend to minimize the area of contact between the glue remaining inside the collapsible tube and the air outside the nozzle. Moreover, some of the tubes are manufactured with sealing diaphragms about the opening of the spout and the cap or nozzle is removable from the spout of the collapsible tube so that the sealing diaphragm can be exposed an punctured and the cap or nozzle quickly inserted on the spout. Of course, it is difficult to puncture the sealing diaphragm without inadvertantly dispensing some of the glue from the collapsible tube, and once the special nozzle is inserted back on the spout, even the relatively small nozzle opening permits at least some air-glue contact and hardening of the glue within the nozzle and collapsible tube. Also, air is sometimes inadvertently aspirated from outside the nozzle, inwardly through the small opening of the nozzle and into the nozzle and the collapsible tube during handling of the dispenser, causing hardening of the glue within the dispenser.

SUMMARY OF THE INVENTION

Briefly described, the present invention comprises a dispenser for glue and the like comprising a collapsible tube with an outlet spout mounted thereon with a sealing diaphragm extending over the opening of the spout and a nozzle assembly threaded on the outlet spout. The nozzle assembly includes an internal nozzle element partially threaded on the outlet spout of the tube which includes a piercing element that pierces the sealing diaphragm of the spout when the internal nozzle element is completely threaded onto the outlet spout. An external nozzle element fits about the internal nozzle element. Also, a nozzle valve is located within the external nozzle element and protrudes through and beyond the external nozzle outlet opening. The nozzle valve is biased into its protruding, closed relationship with respect to the outlet opening of the external nozzle element by a deformable portion of the nozzle valve located inside the external nozzle element which abuts a cam surface on the internal nozzle element, so that when glue is to be dispensed from the collapsible tube, the tube is squeezed and the external nozzle is pressed against the surface to which glue is to be applied, causing the protruding portion of the nozzle valve to be pushed inwardly through the outlet opening of the external nozzle element, thereby causing a small opening to be formed between the nozzle valve and the external nozzle element and permitting the liquid glue to be dispensed therethrough.

Thus, it is an object of this invention to provide a dispenser for glue or the like which includes a collapsible tube with a spout and a sealing diaphragm over the spout, and a nozzle assembly partially threaded onto the spout by the manufacturer that can be threaded further onto the spout by the customer to pierce the sealing diaphragm, and the customer can press the nozzle against a surface to which glue is to be applied which opens the nozzle and the glue is metered therefrom in contact with the surface.

Another object of this invention is to provide a dispenser for glue or the like which is convenient to use and which causes the glue to retain a prolonged shelf life prior to its use and which stores the unused glue within the dispenser without hardening for a prolong period.

Another object of the invention is to provide an inexpensive and durable glue dispenser which functions to repeatedly dispense small amounts of glue and which minimizes the hazzard of the glue becoming hard within the dispenser.

Another object of this invention is to provide a dispenser for glue and the like which preserves the glue in a sealed container until the glue is to be used, and which provides a means of breaking the seal of the container without requiring the container to be disassembled, and when the seal is broken functions to dispense glue only when the outlet opening of its nozzle is in contact with the surface to which glue is to be applied.

Other objects, features and advantages of the present invention will become apparent upon reading the following specification, when taken in conjunction with the accompanying drawings.

DETAILED DESCRIPTION

Figure 1:
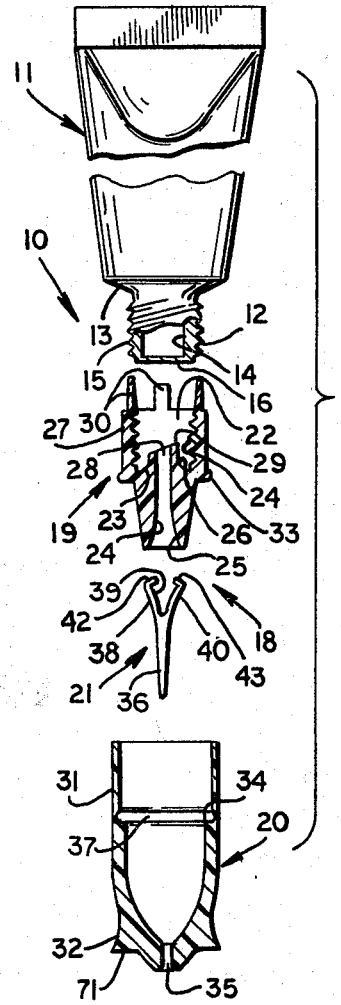
FIG. 1 is an exploded view of the dispenser, with portions shown in cross section.

Referring now in more detail to the drawings, in which like numerials indicate like parts throughout the several views, FIG. 1 illustrates a dispenser 10 which comprises a collapsible tube 11 and its externally threaded spout 12 defining an outlet opening 14 therethrough. The threads 15 of spout 12 extend along the entire length of the spout, and a sealing diaphragm 16 closes the outlet opening 14.

Nozzle assembly 18 includes internal nozzle element 19, external nozzle element 20 and nozzle valve 21. Internal nozzle element 19 includes an internally threaded bore 22, the threads 24 thereof being compatible with the threads 15 of spout 12. A funnel shaped opening 24 also extends through internal nozzle element 19 with its larger opening 25 facing away from collapsible tube 11. Annular piercing element 26 defines an opening 28 therethrough, and the opening 28 as well as the funnel shaped opening 24 are in alignment with each other and communicate longitudinally through internal nozzle element 19. Thus, the bore 22 and openings 24, 28 form an outlet opening for internal nozzle 19. Annular piercing element 26 terminates at an angle so that its protruding tip 29 functions as a sharpened surface to pierce sealing diaphragm 16 of collapsible tube 11. The diameter of annular piercing element 26 is less than the diameter of outlet opening 14 of spout 12, so that when internal nozzle element 19 is completely threaded onto spout 12, the piercing element 26 pierces or breaks the sealing diaphragm 16 so that the contents within collapsible tube 11 are free to be dispensed through the outlet openings of both the spout 12 and internal nozzle element 19. Annular surface 23 which surrounds annular piercing element 26 is sloped upwardly from threaded bore 22 to the piercing element and functions to seal against the outer annular surface of spout 12 when the internal nozzle element 19 is completely threaded on the spout.

Figure 2:
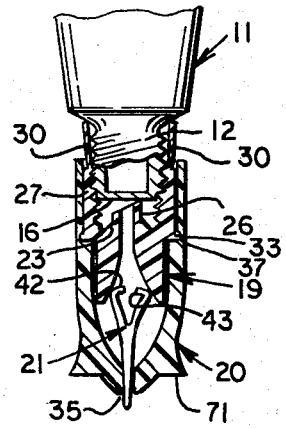
FIG. 2 is a cross sectional view of the dispenser, showing the nozzle assembly mounted on the spout prior to piercing the sealing diaphragm.

A plurality of deformable legs 30 are radially spaced about the base of internal nozzle element 19. When internal nozzle element 19 is initially threaded onto spout 12 of the collapsible tube 11 (FIG. 2), the deformable legs tend to abut the shoulder 13 of the collapsible tube 11, to prevent the internal nozzle element 19 from being threaded all the way on the spout 12. This causes the annular piercing element 26 to be held out of piercing relationship with respect to sealing diaphragm 16. When the internal nozzle element 19 is threaded further on to the spout 12 (FIG. 3), the deformable legs 30 are deformed outwardly about the shoulders 13 of the collapsible tube and the annular piercing element 26 pierces the sealing diaphragm 16. The exterior surface 27 of the upper portion of internal nozzle element 19 is substantially cylindrical and the lower portion is of smaller diameter. Annular locking protrusion 33 surrounds the exterior surface 27.

External nozzle element 20 includes a cylindrical portion 31 and a tapered portion 32. An annular internal shoulder 34 is formed between the cylindrical portion 31 and the tapered portion 32, and an annular locking recess 37 is formed in the cylindrical portion 31 adjacent shoulder 34. The internal diameter of the cylindrical portion 31 is approximately equal to the external diameter of the base portion of internal nozzle element 19 so that when the external nozzle element 20 is inserted about the internal nozzle element 19 (FIGS. 2 and 3), a friction fit is formed therebetween, with annular locking protrusion 33 fitting in annular locking recess 37. An outlet opening 35 is formed at the apex of tapered portion 32 of external nozzle 20.

Figure 3:
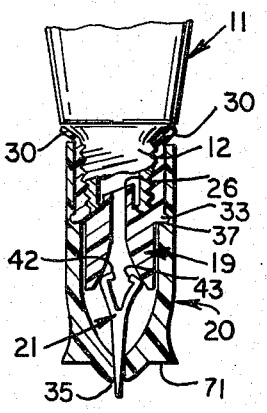
FIG. 3 is a cross sectional view of the dispenser, showing the nozzle assembly after it has pierced the sealing diaphragm.
Figure 4:
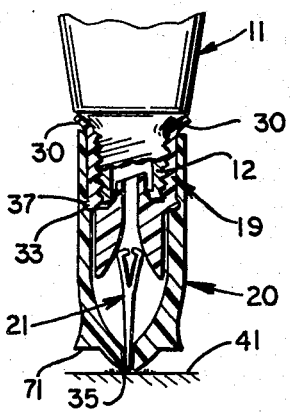
FIG. 4 is a cross sectional view, similar to FIG. 3, of the dispenser, but showing the nozzle valve in its open position.

Nozzle valve 21 includes a valve plunger 36 and a deformable portion 38. The valve plunger is tapered along its length and is arranged to protrude through outlet opening 35 of external nozzle element 20 (FIG. 3). The deformable portion 38 is shaped like a poultry wishbone, including legs 39 and 40 which diverge away from valve plunger 36 with feet 42 and 43 formed on the ends of the wishbone legs 39 and 40. The spacing of legs 39 and 40 is approximately the same as the diameter at the larger opening 25 of the funnel shape opening 24 of internal nozzle element 19. When the nozzle assembly is assembled in the manner illustrated in FIGS. 2–4, the feet 42 and 43 of the legs 39 and 40 engage the larger opening 25 of the funnel shaped opening 24 and the tip of valve plunger 36 protrudes from inside the external nozzle element 20, through the outlet opening 35 and beyond the nozzle element (FIG. 3). When the external nozzle element 20 is pressed against a stationary object 41 (FIG. 4), the protruding tapered tip of valve plunger 36 is urged inwardly with respect to external nozzle element 20. This causes the deformable legs 39 and 40 of the nozzle valve 21 to flex toward each other (FIG. 4) and ride inwardly from the larger opening 25 toward a smaller diameter portion of the funnel shaped opening 24. The feet 41 and 42 are tapered so as to prevent the ends of the wishbone legs from hanging up on the outer rim of internal nozzle element 19. This cracks open the outlet opening 35 of the external nozzle element 20, and the liquid glue within the nozzle and collapsible tube can be dispensed therefrom. The dispensing function is assisted by squeezing the collapsible tube 11.

When the dispenser is withdrawn from the stationary surface 41, the resiliency of the legs 39 and 40 of the nozzle valve 21 immediately causes the legs to move from the smaller toward the larger opening of the funnel shaped opening 24 of internal nozzle element 19, thereby causing nozzle valve 21 to return to its protruding, closed position (FIG. 3). Thus, the funnel-shaped opening 24 functions as a cam surface to urge the valve plunger 36 toward its closed position. Since the liquid glue would have been dispensed through the outlet opening 35 and a pool of the liquid glue would be present on stationary surface 41, the immediate insertion of the valve plunger 36 back into closed relationship with respect to the outlet opening 35 upon retraction of the dispenser from the stationary surface 41 prevents air from entering outlet opening 35.

Figure 5:
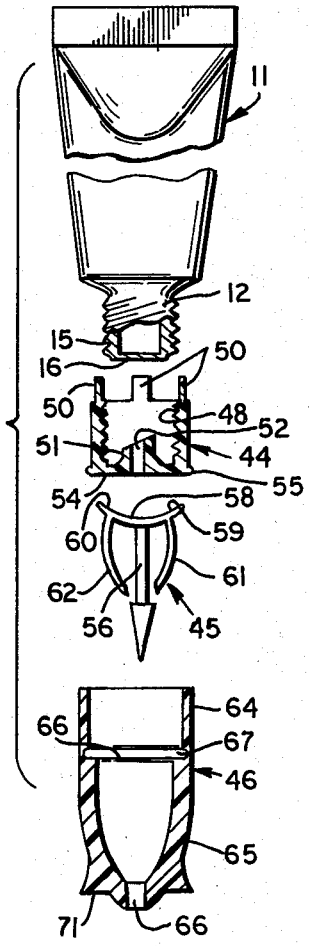
FIG. 5 is an exploded view with parts shown in cross section, of a modified dispenser.
Figure 6:
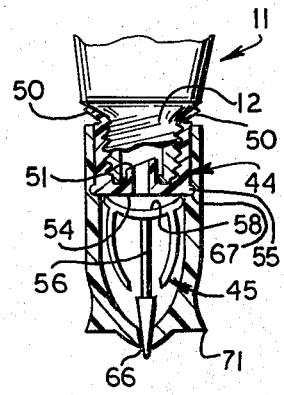
FIG. 6 is a cross sectional view of the dispenser of FIG. 5, showing the nozzle assembly after it has pierced the sealing diaphragm.

As illustrated in FIGS. 5 and 6, a modified form of the invention is disclosed wherein the collapsible tube 11 and its spout 12 are equipped with a modified internal nozzle element 44, a modified nozzle valve 45 and an external nozzle element 46. Internal nozzle element 44 also includes an internal threaded bore 48 which threadedly engages the threads 15 of spout 12, deformable legs 50 circumferentially spaced about bore 48 and annular piercing element 51 which defines an opening 52 therein. The bore 48 and opening 52 form an outlet opening for the internal nozzle element 44, and flat surface 54 comprises a cam surface against which nozzle valve 45 bears. Annular locking protrusion 55 extends about the lower edge of internal nozzle element 44.

Nozzle valve 45 includes valve plunger 56 and deformable portion 58 which engages flat surface 54 of internal nozzle element 44. Deformable portion 58 includes at least two leg elements 59 and 60 that diverge away from valve plunger 56, to hold the valve plunger away from cam surface 54 of internal nozzle element 44, and a support leg 61 and 62 for each leg element 59 and 60. The support legs 61 and 62 move toward engagement with valve plunger 56 when the leg elements 59 and 60 are flexed toward a flat configuration. This particular structure keeps the base of valve plunger 56 from obstructing opening 52 of internal nozzle element 44.

External nozzle element 46 is similar to external element 20 in that it includes a cylindrical portion 64 and a tapered portion 65, with an annular internal shoulder 66 and annular locking recess 67 formed therebetween. The internal diameter of the cylindrical portion 64 is approximately equal to the external diameter of internal nozzle element 44, so that a friction fit between the external nozzle element 46 and the internal nozzle element 44 is created when they are telescoped together.

As illustrated in FIG. 6, when the nozzle assembly of FIG. 5 is assembled, the deformable portion 58 of nozzle valve 45 bears against the flat cam surface 54 of internal nozzle element 44 and the distal tapered end or tip of valve plunger 56 protrudes through outlet opening 66 of external nozzle element 46, and when the external nozzle element 46 and the protruding tip of valve plunger 56 are urged against a stationary object, valve plunger 56 is pushed inwardly of outlet opening 66 and deformable portion 58 flexes against the flat cam surface 54 to permit the inward movement, thereby cracking open the outlet opening 66 to permit glue to be dispensed therethrough.

Figure 7:
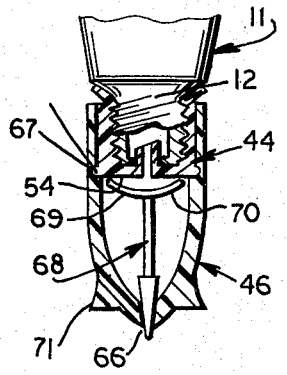
FIG. 7 is a cross sectional view of a glue dispenser, similar to FIG. 6, but showing a modified nozzle valve.

As illustrated in FIG. 7 a second modification of the nozzle assembly is illustrated wherein the same internal nozzle element 44 and external nozzle element 46 are employed, but a modified nozzle valve 68 is used in combination therewith. Nozzle valve 68 is similar to nozzle valve 56, but the support legs 61 and 62 of nozzle valve 45 are absent from modified nozzle valve 68, leaving the diverging legs 69 and 70 without additional support as they flex of deform with respect to the flat cam surface 54 of internal nozzle element 44. Several of the diverging legs 69 and 70 can be formed on the plunger if desired in order to provide additional spring force for the valve plunger. The configuration of the nozzle valve 68 leaves the interior portion of external nozzle element 46 free from additional elements therein.

In each embodiment of the external nozzle element 20, 46, an external annular drip ring 71 is formed to retard the dripping or running of the liquid glue toward the fingers of the user in the event that the user should invert the dispenser. Also, the drip ring 71 provides the user with a gripping surface against which the fingers can press during use of the dispenser, to prevent the fingers from sliding down the entire length of the nozzle assembly.

The material from which the nozzle assemblies are fabricated preferably should be of substances that are compatible with the glue contained in and to be dispensed from the dispenser. For example, if the glue being stored and dispensed from the dispenser is cyanoacrylate, the nozzle assembly can be fabricated from various commercially available thermoplastic resins, including polybutylterephthalate, with the parts thereof being fabricated by conventional mold techniques.

It should be understood, of course, that the foregoing relates only to preferred embodiments of the present invention and that numerous modifications or alterations may be made therein without departing from the spirit and the scope of the invention as set forth in the appended claims.

We claim:

1. A dispenser for glue or the like comprising a container with an externally threaded spout defining an outlet opening therethrough, a nozzle assembly for attachment to said spout, said nozzle assembly comprising an internal nozzle element including an outlet opening extending therethrough a funnel shaped cam surface which defines part of said outlet opening and internal threads for engaging the threads of the externally threaded spout, an external nozzle element mounted about said internal nozzle element and including an outlet opening extending therethrough, and a deformable nozzle valve including an end portion protruding from inside said external nozzle element and a deformable portion in sliding engagement with the funnel-shaped cam surface of said internal nozzle element whereby when the protruding end portion of the nozzle valve is pushed inwardly with respect to the outlet opening of said external nozzle element said deformable portion of the nozzle valve deforms against the funnel-shaped cam surface to permit the nozzle valve to move inwardly with respect to the external nozzle element and the contents of the container are movable through the outlet opening of the spout and the outlet openings of the internal and external nozzle elements.

2. The dispenser of claim 1 and wherein a sealing diaphragm extends over the outlet opening of said spout, and wherein said internal nozzle element includes a piercing element extending toward said sealing diaphragm, and deformable means for holding said internal nozzle element from being fully threaded onto said spout with the piercing element of said internal nozzle element not extending through the sealing diaphragm, whereby when the internal nozzle element is fully threaded onto the spout the deformable means deforms and the piercing element pierces the sealing diaphragm.

3. The dispenser of claim 2 and wherein said piercing element surrounds the outlet opening of said internal nozzle element.

4. A dispenser for glue or the like comprising a container with a threaded spout and defining an outlet opening therethrough, a sealing diaphragm extending over said outlet opening, a nozzle assembly for attachment to said spout, said nozzle assembly including a threaded internal nozzle element threadedly engaging said threaded spout, said internal nozzle element having an outlet opening therethrough, a cam surface and an annular piercing element surrounding said outlet opening and extending toward said sealing diaphragm, deformable means for preventing said annular piercing element from inadvertently piercing said sealing diaphragm, an external nozzle element defining an outlet opening therethrough, a nozzle valve in said external nozzle element protruding from within said external nozzle element for closing the outlet opening of said external nozzle element, and said nozzle valve including a deformable portion in engagement with said cam surface of said internal nozzle element for biasing said nozzle valve into closed relationship with respect to the outlet opening of said external nozzle element, whereby when said internal nozzle element is threaded fully onto the threaded spout of the container the annular piercing element pierces the sealing diaphragm, and when the protruding end portion of the nozzle valve is pushed inwardly with respect to the outlet opening of the external nozzle the deformable portion of the nozzle valve deforms against the cam surface of the internal nozzle element and a passage is formed from within the container and through the internal and external nozzle elements.

5. In a dispenser assembly for glue or the like including a container with a spout defining an outlet opening therethrough, the improvement therein of a nozzle assembly for attachment to said spout, said nozzle assembly comprising an internal nozzle element including an outlet opening extending therethrough, means for connecting the internal nozzle element to the nozzle of the container with the outlet opening of the internal nozzle element aligned with the outlet opening of the spout of the container, and a cam surface formed on the internal nozzle element, said cam surface being approximately funnel-shaped and concentric with respect to the outlet opening of said internal nozzle element, an external nozzle element mounted to said internal nozzle element and including an outlet opening extending therethrough, and a deformable nozzle valve including an end portion protruding from inside said external nozzle element through the outlet opening of said external nozzle element and a deformable portion in engagement with the cam surface of said internal nozzle element, said deformable portion of said nozzle valve comprising at least two diverging leg elements extending toward said cam surface, whereby when the protruding end portion of the nozzle valve is pushed inwardly with respect to the outlet opening of said external nozzle element the leg elements of the nozzle valve deform and move along the funnel-shaped cam surface to permit the nozzle valve to move inwardly with respect to the external nozzle element and the contents of the container are movable through the outlet opening of the spout and the outlet openings of the internal and external nozzle elements.

6. A dispenser for glue or the like comprising a container with an externally threaded spout defining an outlet opening therethrough, a sealing diaphragm extending over the outlet opening of said spout, a nozzle assembly for attachment to said spout, said nozzle assembly comprising an internal nozzle element including an outlet opening extending therethrough, a funnel-shaped cam surface surrounding the outlet opening, and internal threads for engaging the threads of the externally threaded spout, a piercing element surrounding the outlet opening of said internal nozzle element and extending toward said sealing diaphragm, and a deformable means for holding said piercing element away from said sealing diaphragm, an external nozzle element mounted to said internal nozzle element and including an outlet opening extending therethrough, and a deformable nozzle valve including a tapered end portion protruding from inside said external nozzle element through the outlet opening of said external nozzle element and a deformable portion in engagement with the cam surface of said internal nozzle element whereby when the protruding end portion of the nozzle valve is pushed inwardly with respect to the outlet opening of said external nozzle element the deformable portion of the nozzle valve deforms against the funnel-shaped cam surface to permit the nozzle valve to move inwardly with respect to the external nozzle element and the contents of the container are movable through the outlet opening of the spout and the outlet openings of the internal and external nozzle elements.

* * * * *